US006845563B2

(12) United States Patent
Lewis et al.

(10) Patent No.: US 6,845,563 B2
(45) Date of Patent: Jan. 25, 2005

(54) METHOD AND DEVICE FOR THE MEASUREMENT OF THE DRIFT OF A BORCHOLE

(75) Inventors: Jonathan Robert Lewis, Wetaskiwin (CA); Robert Everett Hewitt, Edmonton (CA)

(73) Assignee: Precision Drilling Technology Services Group, Inc., Calgary (CA)

( * ) Notice: Subject to any disclaimer, the term of this patent is extended or adjusted under 35 U.S.C. 154(b) by 0 days.

(21) Appl. No.: 10/207,383

(22) Filed: Jul. 30, 2002

(65) Prior Publication Data

US 2004/0020063 A1 Feb. 5, 2004

(51) Int. Cl.[7] ..... E21B 47/022

(52) U.S. Cl. ..... 33/313; 33/304; 33/1 H; 73/152.46; 175/45; 340/853.8

(58) Field of Search ..... 33/304, 313, 1 H; 73/152.01, 152.46, 152.54; 175/45; 340/853.8, 853.4, 853.5, 853.6; 702/10

(56) References Cited

U.S. PATENT DOCUMENTS 4,021,774 A * 5/1977 Asmundsson et al. ..... 33/313
4,454,756 A * 6/1984 Sharp et al. ..... 33/313
4,459,759 A * 7/1984 Hulsing, II ..... 33/304
4,479,564 A * 10/1984 Tanguy ..... 33/304
4,542,647 A * 9/1985 Molnar ..... 33/304
4,706,388 A * 11/1987 Van Steenwyk ..... 33/304
5,657,547 A * 8/1997 Uttecht et al. ..... 33/304
6,065,219 A * 5/2000 Murphey et al. ..... 33/304
6,351,891 B1 * 3/2002 MacGugan ..... 33/304
6,381,858 B1 * 5/2002 Shirasaka ..... 33/304
6,453,239 B1 * 9/2002 Shirasaka et al. ..... 33/304
6,480,119 B1 * 11/2002 McElhinney ..... 33/304

* cited by examiner

*Primary Examiner*—Christopher W. Fulton
*Assistant Examiner*—Madeline Gonzalez
(74) *Attorney, Agent, or Firm*—Merek, Blackmon & Voorhees, LLC

(57) ABSTRACT

A device and a method for the measurement of the angle of drift of a borehole that extends from the surface of the ground downwardly into the earth. The device comprises a generally hollow protective exterior casing, a microprocessor control; and, a sensor pack. At least the microprocessor control and the sensor pack are received and contained within the exterior casing. The sensor pack includes one or more accelerometers mounted upon a sensor chassis that is positioned within the casing and situated generally parallel to its longitudinal axis. The sensor chassis has one or more mounting surfaces for receiving and securing the one or more accelerometers to the sensor chassis. The mounting surfaces are configured such that the one or more accelerometers when secured to the chassis are held and retained at an inclined angle relative to the longitudinal axis of the exterior casing and the device.

23 Claims, 4 Drawing Sheets

METHOD AND DEVICE FOR THE MEASUREMENT OF THE DRIFT OF A BORCHOLE

FIELD OF THE INVENTION

This invention relates to both a method and an apparatus to measure the drift or deviation of a well or borehole from vertical.

BACKGROUND OF THE INVENTION

When boreholes or wells are drilled into the earth for mining purposes, for the drilling of oil and gas wells, or for any one of a wide variety of other reasons, it is generally advantageous, or in some cases critical, to survey and record the progression of the drill bit and the position of the borehole in order to monitor bore drift and the angle of inclination of the well. The availability of a method and apparatus that enables a drill operator to map the progression of the well and to monitor the angle of its inclination is particularly important where there is a desire to drill into a specific underground formation. Knowing the location of the drill bit, and knowing the angle of inclination of the well relative to vertical, can also be extremely important when drilling deep wells, and in the case of oil and gas drilling where a large number of wells are sometimes drilled in a closely spaced configuration within a confined geographic area.

To assist drillers in monitoring and logging the inclination and progression of a borehole, others have devised and proposed a wide variety of different measurement devices. Such devices are generally capable of determining the location of a portion of a borehole or a drill bit relative to its surface entry point based upon a defined coordinate system. Most commonly a Cartesian coordinate system is utilized and centered at the wellhead with the "Z" axis defined as extending from the wellhead toward the center of the earth and the "X" and "Y" axes extending in a north-south and east-west configuration, respectively. Typical devices that are currently in use for surveying or mapping a borehole comprise downhole tools or probes that contain instrument packages capable of taking measurements and sending signals to equipment at the surface that can be used to plot the position of the borehole. The instrument packages of such tools or probes commonly contain gyroscopes, magnetic compasses, pendulums, accelerometers, and devices or sensors to measure the length of the borehole from the wellhead to the downhole tool.

While such devices have been in use for a considerable length of time, they continue to suffer from a number of inherent limitations and disadvantages, one of the more significant of which is their cost. In the drilling of oil and gas wells the depletion of relatively shallow and accessible hydrocarbon deposits has resulted in the necessity to drill deeper boreholes and to target smaller geographical formations. In deep wells there is an enhanced requirement for producing an accurate survey of the borehole as even a small degree of drift can become very significant over the span of several thousand feet. For this reason, the tools and probes that have been developed and that are currently in use tend to include instrument packages having relatively sensitive sensors. Unfortunately while these sensors are designed to be reasonably accurate they tend to be susceptible to mechanical noise, which is relatively common in the downhole environment where they are required to operate.

The effects of background or mechanical noise is particularly troublesome when measuring small angles of drift or inclination. Accordingly, to offset the effect of noise and the error that noise can introduce into sensor readings, manufacturers of existing systems have resorted to using high quality (and hence expensive) sensors, in conjunction with noise filters, to help minimize the noise effect and to help to send a "cleaner" signal to the surface. Such systems are inherently more complex, present increased opportunity for malfunction or breakdown, and can significantly increase the overall cost of the tool.

SUMMARY OF THE INVENTION

The invention therefore provides a method and an apparatus for the measurement of the drift of a well or borehole that is less susceptible to the effects of mechanical noise, particularly at small angles of measurement. The invention provides for such a method and apparatus that generally reduces the number of electronic components required, can be manufactured more easily and less expensively, and that is less susceptible to malfunction and mechanical breakdown.

Accordingly, in one of its aspects the invention provides a device for the measurement of the angle of drift of a borehole that extends from the surface of the ground downwardly into the earth, the device comprising; a generally hollow protective exterior casing; a microprocessor control; and, a sensor pack, wherein at least said microprocessor control and said sensor pack are received and contained within said exterior casing, said sensor pack including one or more accelerometers mounted upon a sensor chassis that is positioned within said exterior casing and situated generally parallel to the longitudinal axis of said exterior casing, said sensor chassis having one or more mounting surfaces for receiving and securing said one or more accelerometers to said sensor chassis, said mounting surfaces configured such that said one or more accelerometers when secured to said chassis are held and retained at an inclined angle relative to the longitudinal axis of said exterior casing and said device.

In a further aspect the invention provides a tool for the measurement of the angle of inclination of a borehole extending into the earth, the tool comprising; an elongate casing; a microprocessor control; and, a sensor pack, wherein at least said microprocessor control and said sensor pack are received and contained within said casing, said sensor pack including one or more electronic accelerometers, said one or more accelerometers including an inclination sensor mounted upon an electronic circuit board at an inclined angle such that said inclination sensor is positioned and retained at an inclined angle relative to the longitudinal axis of said casing and said tool.

In yet a further aspect the invention concerns a method for measuring the angle of drift of a borehole that extends from the surface of the ground downwardly into the earth, the method comprising the steps of; situating and positioning within the borehole a drift measurement tool including a microprocessor control and a sensor pack, said sensor pack including one or more accelerometers mounted upon a sensor chassis having a longitudinal axis generally parallel to the longitudinal axis of said tool, said one or more accelerometers each including an inclination sensor, said sensor chassis having one or more mounting surfaces for receiving and securing said one or more accelerometers to said chassis, said mounting surfaces and said accelerometers together configured such that the inclination sensors of said one or more accelerometers, when said one or more accelerometers are secured to said chassis, are held and retained at an inclined angle relative to the longitudinal axis of said tool; applying a source of electrical power to said tool; and, causing the inclination sensors of said one or more accelerometers to generate signals corresponding to their angle of inclination that are sent to and received and stored by said microprocessor control.

Further aspects and advantages of the invention will become apparent from the following description taken together with the accompanying drawings.

BRIEF DESCRIPTION OF THE DRAWINGS

For a better understanding of the present invention, and to show more clearly how it may be carried into effect, reference will now be made, by way of example, to the accompanying drawings which show the preferred embodiments of the present invention in which.

DESCRIPTION OF THE PREFERRED EMBODIMENT

The present invention may be embodied in a number of different forms. However, the specification and drawings that follow describe and disclose only some of the specific forms of the invention and are not intended to limit the scope of the invention as defined in the claims that follow herein.

Figure 1:
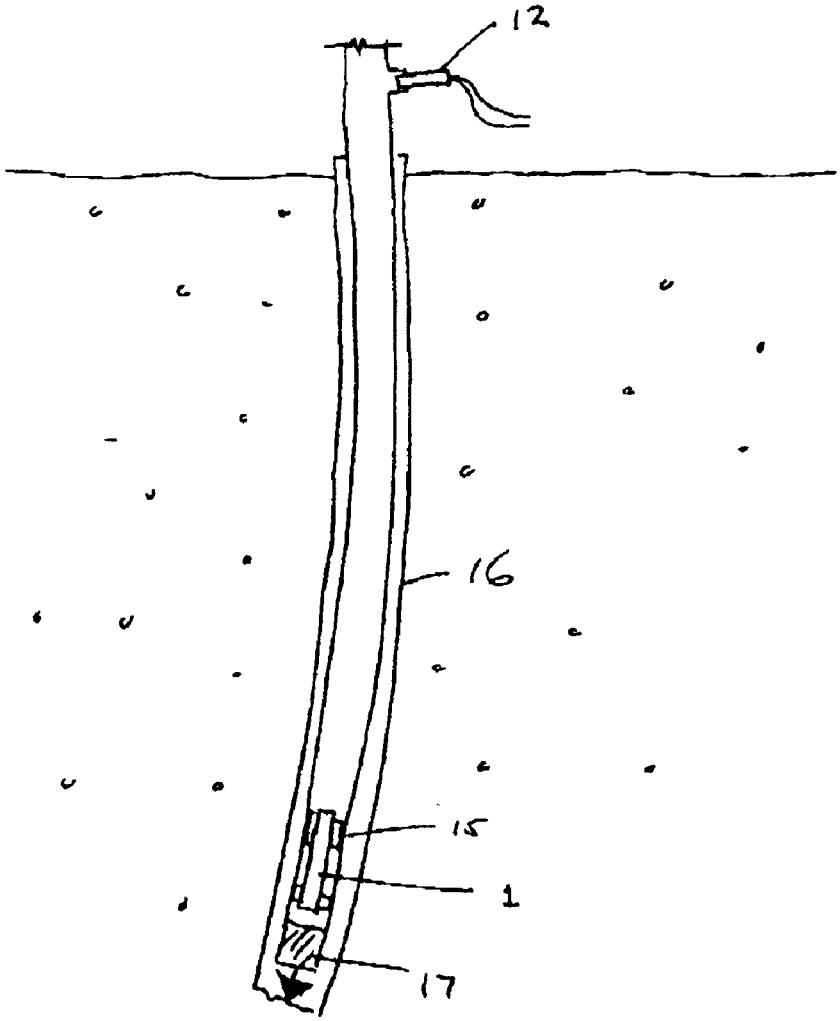
FIG. 1 is a pictorial view of a borehole having received therein a drift measurement tool in accordance with the present invention.
Figure 2:
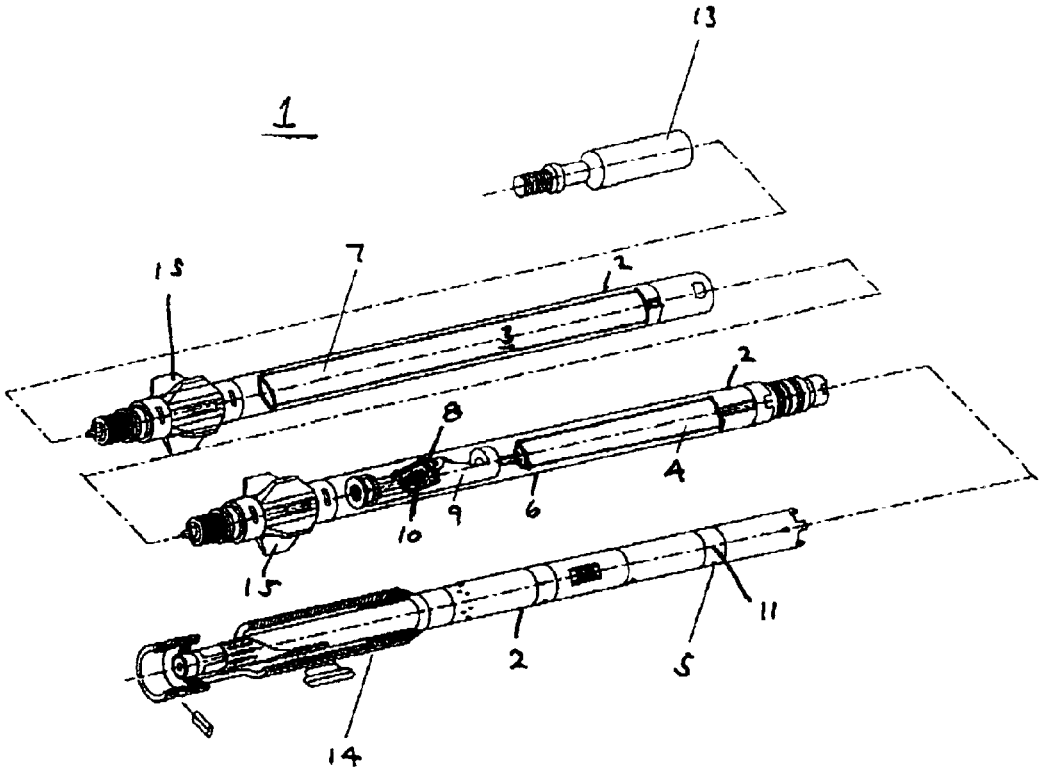
FIG. 2 is a partially exploded and partial longitudinal sectional view of the drift measurement tool in accordance with one preferred embodiment of the invention; and, FIG. 3 is an enlarged upper side perspective detail view of the sensor chassis in accordance with one preferred embodiment of the invention.

The device in accordance with the present invention, which may generally be referred to as a drift measurement tool, is shown and identified in the attached drawings generally by reference numeral 1. In FIG. 1 the drift measurement tool is shown pictorially as it may be used within a borehole 16 in conjunction with a downhole drill 17. In a typical configuration tool 1 would be comprised of a generally hollow protective exterior casing 2, a microprocessor control 4, a transmitter 5, and a sensor pack 6. As shown in FIG. 2, tool 1 may also include a spear point or fish end 13, and anchor 14 and a series of stabilizing fins 15. To operate the sensors and electronic components of the tool, there is preferably provided a source of electrical energy in the form one or more batteries 7. Typically batteries 7 will be of an extended life variety (for example lithium batteries) in order to provide sufficient power to operate the tool for a considerable length of time. In other cases electrical power could be supplied through conductors extending downwardly from the surface to the tool or, alternatively, the tool could be fitted with a turbine and generator such that it is capable of producing its own electrical power.

To protect some of the more sensitive elements of the tool, at least the microprocessor control 4 and sensor pack 6 are received and contained within exterior casing 2. However, in many instances it is expected that an elongate casing will be utilized that is sufficient in size to also house batteries 7 and transmitter 5. For manufacturing, assembly and maintenance purposes exterior casing 2 may be formed in a number of sections that are threaded or otherwise secured together in a fashion that prevents in the ingress of fluids and other debris into the interior of the casing.

In accordance with the invention sensor pack 6 includes one or more accelerometers 8 that are preferably mounted upon a sensor chassis 9. The accelerometers utilized in the invention may be any one of a number of currently available accelerometers, but are preferably electronic accelerometers having an inclination sensor mounted on a circuit board. Sensor chassis 9 is situated and positioned within exterior casing 2 such that it is generally parallel to the longitudinal axis of casing 2 and tool 1. Sensor chassis 9 would typically be constructed from a rigid material that is suitable, from both a strength and thermal expansion standpoint, for general use in a borehole. In most cases it is expected that sensor chassis 9 will be formed from a metal or metallic compound, however, in some instances it may also be formed from a synthetic compound having a sufficient structural rigidity for downhole applications.

Figure 3:
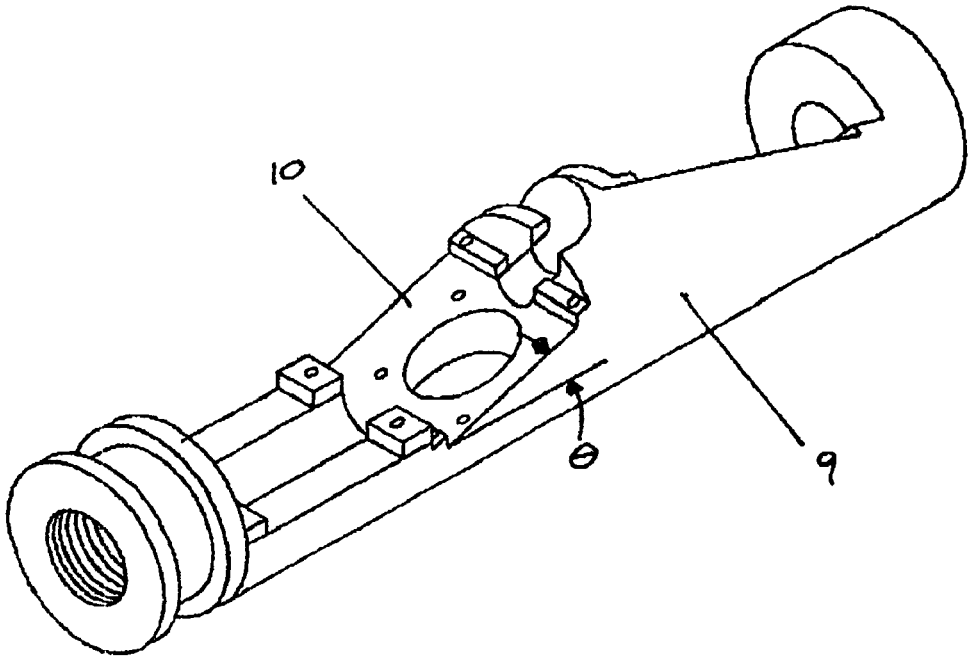

The physical configuration of sensor chassis 9 is such that it contains one or more mounting surfaces 10 for receiving and securing to the chassis one or more accelerometers 8. In the embodiment of the invention shown in FIGS. 2 and 3 mounting surfaces 10 are at an inclined angle (angle in FIG. 3)relative to the longitudinal axis of sensor chassis 9. In this manner when accelerometers 8 are secured with their circuit boards attached to mounting surfaces 10 they will beheld and retained at an inclined angle relative to the longitudinal axis of exterior casing 2, tool 1, and the borehole within which the tool is situated. With the accelerometer's inclination sensors perpendicular to their circuit boards, the inclination sensors will therefore also be held in an inclined orientation relative to the longitudinal axis of the tool. It is expected that in most instances mounting surfaces 10 would be inclined relative to sensor chassis 9 at an angle from about 1 degree to 45 degrees, with a preferred range of approximately 5 degrees to approximately 20 decrees.

Figure 4:
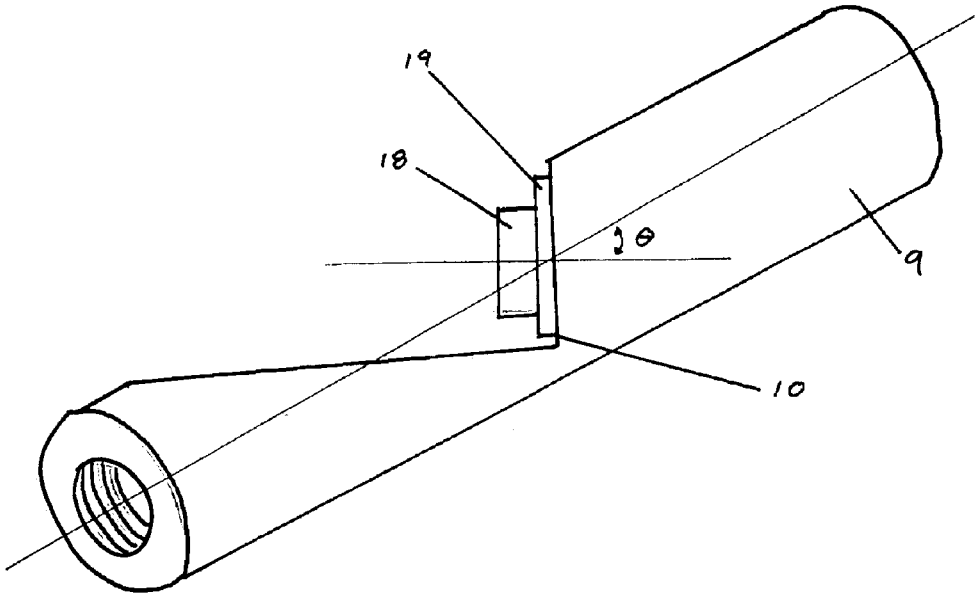
FIG. 4 is an enlarged upper side perspective view of the sensor chassis in accordance with one referred embodiment of the invention.

In a further embodiment of the invention accelerometers 8 include inclination sensors 18 that are mounted upon an electronic circuit board 19 at an inclined angle (See FIG. 4). In this embodiment mounting surfaces 10 of sensor chassis 9 are parallel to the longitudinal axis of the chassis such that when the circuit boards of the accelerometers are secured to chassis 9 their circuit boards will be parallel to the axis of the chassis. However, since the inclination sensors of the accelerometers are inclined relative to their circuit boards, the inclination sensors will thus be retained at an inclined angle relative to the sensor chassis, the tool and the borehole within it is situated.

Regardless of whether tool 1 utilizes a sensor chassis with inclined accelerometer mounting surfaces, or whether the accelerometers are designed with inclination sensors mounted at an inclined angle relative to their circuit boards with the circuit boards mounted on the sensor chassis parallel to longitudinal axis of the chassis, the end result will be the same. In each case the inclination sensors will be positioned at an inclined angle relative to both the tool and the borehole. Since the inclination sensors are generally designed for vertical mounting, microprocessor control 4 will contain software to compensate and account for the inclination of the sensors within the tool.

Preferably two accelerometers 8 are utilized and positioned upon sensor chassis 9 in such a manner that their inclination sensors are in planes that are perpendicular to one another. In this fashion signals generated by the two accelerometers may be used to determine the degree of inclination of a borehole in the "X" and "Y" directions in a standard Cartesian coordinate system. However, it will be appreciated by those skilled in the art that depending upon the degree of accuracy required, the amount of build-in redundancy desired for an individual tool, and the level of sophistication programmed into microprocessor 4, one, two, three, or more accelerometers could equally be used.

Referring again to FIG. 2, in the embodiment of the invention that is shown transmitter 5 is a pulsar 11 that transmits signals to the surface of the ground through mud pulse telemetry. Batteries 7 are used to power the pulsar, with the transmission of signals controlled by microprocessor 4. In this embodiment a transducer 12, operatively connected to the borehole at the surface of the ground, is used in conjunction with pulsar 11. Typically in oil and gas well drilling applications transducer 12 would be installed in the standpipe above the borehole such that signals can be transmitted from pulsar 11 to transducer 12 through well-known means of mud pulse telemetry. Signals received by transducer 12 may then be directed to surface analysis and/or recordal equipment to analyze the signals, plot or chart the position of the borehole, or calculate the angle of drift or inclination from vertical. It should be appreciated that in further embodiments of the invention signals may be transmitted from tool 1 to the surface of the borehole by wire line technology, electromagnetic telemetry, or acoustic telemetry.

The operation of tool 1 will now be described with respect to a scenario where the tool is in position in a well during a drilling operation. For illustration purposes only, the operation of tool 1 as set out below is described in conjunction with mud pulse telemetry. The operation of tool 1 will generally be same for embodiments that utilize wire line technology, electromagnetic telemetry, or acoustic telemetry.

In one embodiment of the invention the drift measurement tool includes a vibration sensor that is able to detect the cessation of drilling operations by means of a lack of vibration when the flow of drilling mud or fluid is stopped. When readings from the vibration sensor indicate that drilling has ceased, microprocessor control 4 will cause accelerometers 8 to be queried and signals corresponding to the angle of inclination of the inclination sensors on the accelerometers will be generated by the accelerometers and received by and stored within the microprocessor. Accordingly, if a drill operator wishes to conduct a survey of the inclination of the borehole all that is required is to stop the drilling operation for a relatively short period of time, allowing the vibration sensors to activate microprocessor 4. The collection of data from the accelerometers and the storage of that data within the microprocessor will typically take from one to two minutes to complete, after which the pumping of drilling fluid or mud may be reinstated by the drill operator.

As the drilling processes resumes and mud once again starts to flow the vibration sensor will detect the flow of the mud and sends a signal to microprocessor control 4 which then activates pulsar 11. The pulsar will then transmit the data received and stored from the accelerometers by means of mud pulse telemetry (generally referred to as a tool position signal). The data that is transformed into a positive pulse is seen as an increase in standpipe pressure at the surface and is captured by transducer 12. The data may then be directed to a chart recorder for printing or forwarded to surface equipment for analysis and subsequent recordal. Once the data has been received and recorded at the surface normal drilling operations may be resumed with tool 1 remaining in place until such time as a further survey is desired. After the pulsar has been activated and transmits the data to the surface the downhole tool will essentially enter a sleep mode to conserve power until again activated through a cessation of drilling operations and the lack of vibration as sensed by the vibration sensor.

By offsetting the inclination sensors of accelerometers 8 such that they are at an inclined angle relative to the longitudinal axis of the tool and the borehole, it has been found that the effects of mechanical noise (that are otherwise present when transducers are mounted perpendicular to the axis of interest) are significantly reduced. The readings and results from the tool have also been found to be considerably more repeatable. Accordingly, it has been found that through the described structure and method lower priced accelerometers can be utilized, without the need for expensive noise filters. The described stricture and method has been found to be proficient in measuring wellbore drift angles to a resolution of approximately 0.25 degrees, and between a range of 0 degrees to approximately 10.75 degrees without requiring adjustments to the downhole assembly. With an enhanced software programming the tool is capable of measuring drift up to 90 degrees. If desired, additional sensors may be placed within tool 1 to record other physical characteristics of the borehole with the corresponding data concerning those characteristics transmitted to the surface in a similar manner.

It is to be understood that what has been described are the preferred embodiments of the invention and that it may be possible to make variations to these embodiments while staying within the broad scope of the invention. Some of these variations have been discussed while others will be readily apparent to those skilled in the art.

We claim:

1. A device for the measurement of the angle of drift of a borehole that extends from the surface of the ground downwardly into the earth, the device comprising:

(i) a generally hollow protective exterior casing;

(ii) a microprocessor control; and, (iii) a sensor pack, wherein at least said microprocessor control and said sensor pack are received and contained within said exterior casing, said sensor pack including one or more accelerometers mounted upon a sensor chassis that is positioned within said exterior casing and situated generally parallel to the longitudinal axis of said exterior casing, said sensor chassis having one or more mounting surfaces for receiving and securing said one or more accelerometers to said sensor chassis, said mounting surfaces configured such that said one or more accelerometers when secured to said chassis are held and retained at an inclined angle of from 1° to 450° relative to the longitudinal axis of said exterior casing and said device.

2. The device as claimed in claim 1 including a transmitter for transmitting signals from said device to the surface of the ground when said device is received in a borehole.

3. The device as claimed in claim 2 wherein said transmitter is a pulsar that transmits signals to the surface of the ground through mud pulse telemetry.

4. The device as claimed in claim 3 further including a transducer operatively connected to the borehole at the surface of the ground, said signals transmitted by said pulsar received by said transducer and directed to surface analysis and recordal equipment.

5. The device as claimed in claim 2 wherein said transmitter is a signal generator for generating and transmitting signals to the surface of the ground through electromagnetic telemetry.

6. The device as claimed in claim 1 having two electronic accelerometers positioned upon said sensor chassis in planes that are perpendicular to one another.

7. The device as claimed in claim 1 including a battery, said battery providing electrical power to said microprocessor control and said one or more accelerometers.

8. A tool for the measurement of the angle of inclination of a borehole extending into the earth, the tool comprising:

(i) an elongate casing;

(ii) a microprocessor control; and, (iii) a sensor pack, wherein at least said microprocessor control and said sensor pack are received and contained within said casing, said sensor pack including one or more electronic accelerometers, said one or more accelerometers including an inclination sensor mounted upon an electronic circuit board at an inclined angle such that said inclination sensor is positioned and retained at an inclined angle of from 1° to 45° relative to the longitudinal axis of said casing and said tool.

9. The device as claimed in claim 8 including a transmitter for transmitting signals from said device to the surface of the ground when said device is received in a borehole.

10. The tool as claimed in claim 9 wherein said transmitter is a pulsar that transmits signals to the surface of the ground through mud pulse telemetry, said tool including a transducer operatively connected to the borehole at the surface of the ground, said signals transmitted by said pulsar received by said transducer and directed to surface analysis and recordal equipment.

11. The device as claimed in claim 9 wherein said transmitter is a signal generator for generating and transmitting signals to the surface of the ground through electromagnetic telemetry.

12. The tool as claimed in claim 8 including two accelerometers, said inclination sensors of said accelerometers positioned in planes that are perpendicular to one another.

13. The tool as claimed in claim 8 including a sensor chassis positioned within said elongate casing with its longitudinal axis parallel to the longitudinal axis of said casing, said one or more accelerometers mounted and secured to said sensor chassis such that said inclination sensors are positioned and retained at an inclined angle relative to the longitudinal axis of said chassis and said tool.

14. The tool as claimed in claim 8 wherein including a battery, said battery providing electrical power to said microprocessor control and said one or more accelerometers.

15. A method for measuring the angle of drift of a borehole that extends from the surface of the ground downwardly into the earth, the method comprising the steps of:

(i) situating and positioning within the borehole a drift measurement tool including a microprocessor control and a sensor pack, said sensor pack including one or more accelerometers mounted upon a sensor chassis having a longitudinal axis generally parallel to the longitudinal axis of said tool, said one or more accelerometers each including an inclination sensor, said sensor chassis having one or more mounting surfaces for receiving and securing said one or more accelerometers to said chassis, said mounting surfaces and said accelerometers together configured such that the inclination sensors of said one or more accelerometers, when said one or more accelerometers are secured to said chassis, are held and retained at an inclined angle of from about 1° to 45° relative to the longitudinal axis of said tool;

(ii) applying a source of electrical power to said tool; and, (iii) causing the inclination sensors of said one or more accelerometers to generate signals corresponding to their angle of inclination that are sent to and received and stored by said microprocessor control.

16. The method as claimed in claim 15 wherein said tool includes a transmitter and said method includes the step of causing said microprocessor control to activate said transmitter to transmit tool position signals from said tool to the surface of the ground.

17. The method as claimed in claim 16 wherein said transmitter is a pulsar and the transmission of signals from said pulsar to the surface of the ground is accomplished through mud pulse telemetry.

18. The method as claimed in claim 16 wherein said step of transmitting signals from said transmitter to the surface of the ground is accomplished through electromagnetic telemetry.

19. The method as claimed in claim 16 wherein said step of transmitting signals from said transmitter to the surface of the ground is accomplished through acoustic telemetry.

20. The method as claimed in claim 15 including the step of mounting two electronic accelerometers upon said sensor chassis such that the inclination sensors of said electronic accelerometers are held in planes that are perpendicular to one another.

21. The method as claimed in claim 15 used in conjunction with the process of drilling said borehole, said method including the step of causing said microprocessor to query said one or more accelerometers upon the cessation of drilling operations, said microprocessor receiving and storing data transmitted from said accelerometers.

22. The method as claimed in claim 21 wherein said tool includes a transmitter and said method includes the further step of causing said microprocessor to process said data received from said accelerometers and thereafter activate said transmitter to transmit signals to the surface of the ground upon the resumption of drilling operations.

23. The method as claimed in claim 22 including the step of utilizing surface receiving equipment to receive said signals transmitted by said transmitter for subsequent analysis and recordal.

* * * * *

UNITED STATES PATENT AND TRADEMARK OFFICE

CERTIFICATE OF CORRECTION

PATENT NO. : 6,845,563 B2 
DATED : January 25, 2005
INVENTOR(S) : Jonathan Robert Lewis and Robert Everett Hewitt It is certified that error appears in the above-identified patent and that said Letters Patent is hereby corrected as shown below:

Column 6,
Line 50, "450°" has been changed to read -- 45° --.

Signed and Sealed this

Tenth Day of May, 2005

JON W. DUDAS
*Director of the United States Patent and Trademark Office*